United States Patent [19]

Evans et al.

[11] 4,284,272

[45] Aug. 18, 1981

[54] EXERCISE MACHINES

[75] Inventors: Harold R. Evans; Ian J. Cunnington, both of Jersey, Channel Islands

[73] Assignee: Tekron Licensing B.V., De Leersum, Netherlands

[21] Appl. No.: 10,615

[22] Filed: Feb. 9, 1979

[30] Foreign Application Priority Data

| | | | |
|---|---|---|---|
| Feb. 10, 1978 | [GB] | United Kingdom | 5499/78 |
| Aug. 7, 1978 | [GB] | United Kingdom | 32501/78 |
| Aug. 7, 1978 | [GB] | United Kingdom | 32506/78 |

[51] Int. Cl.[3] ..... A63B 69/06

[52] U.S. Cl. ..... 272/72; 188/65.4; 272/133; 272/DIG. 5; 272/67; 272/143

[58] Field of Search ..... 272/72, 125, 131, 132, 272/133, 134, DIG. 3, DIG. 4, DIG. 5; 188/65.4, 1 C

[56] References Cited

U.S. PATENT DOCUMENTS

| | | | |
|---|---|---|---|
| 319,686 | 6/1885 | Farmer | 272/131 |
| 693,701 | 2/1902 | Gossmann | 272/72 UX |
| 1,625,447 | 4/1927 | Benice | 272/72 |
| 1,650,417 | 11/1927 | Benniger . | |
| 1,867,642 | 7/1932 | Woods . | |
| 1,974,445 | 9/1934 | Calleson | 272/72 |
| 2,251,120 | 7/1941 | Davis | 272/72 |
| 2,475,667 | 7/1949 | Jackson | 272/72 |
| 2,578,753 | 12/1951 | Smith | 188/65.4 |
| 2,725,231 | 11/1955 | Hoover | 272/72 |
| 3,544,105 | 12/1970 | Latta | 272/133 |
| 3,596,907 | 8/1971 | Brighton et al. | 272/131 |
| 3,885,789 | 5/1975 | Deluty et al. . | |
| 3,995,853 | 12/1976 | Deluty . | |
| 4,010,948 | 3/1977 | Deluty | 272/133 |

FOREIGN PATENT DOCUMENTS

| | | | |
|---|---|---|---|
| 301954 | 11/1917 | Fed. Rep. of Germany | 272/72 |
| 806125 | 9/1936 | France | 272/72 |
| 178577 | 10/1935 | Switzerland | 272/72 |
| 333452 | 12/1958 | Switzerland | 188/65.4 |
| 290689 | 5/1928 | United Kingdom . | |
| 347533 | 4/1931 | United Kingdom | 272/72 |
| 376851 | 7/1932 | United Kingdom . | |
| 389682 | 3/1933 | United Kingdom . | |
| 419982 | 11/1934 | United Kingdom . | |
| 438128 | 11/1935 | United Kingdom . | |
| 466901 | 6/1937 | United Kingdom . | |
| 484917 | 5/1938 | United Kingdom . | |
| 501525 | 2/1939 | United Kingdom . | |
| 607460 | 8/1948 | United Kingdom . | |
| 658552 | 10/1951 | United Kingdom . | |
| 1060281 | 3/1967 | United Kingdom . | |
| 1083705 | 9/1967 | United Kingdom . | |
| 1108199 | 4/1968 | United Kingdom . | |
| 1149128 | 4/1969 | United Kingdom . | |

*Primary Examiner*—Richard C. Pinkham
*Assistant Examiner*—Arnold W. Kramer
*Attorney, Agent, or Firm*—Brumbaugh, Graves, Donohue & Raymond

[57] ABSTRACT

Exercising equipment of the rowing machine type, with a foot rest, a sliding seat, and a pivoted T handle. Work done by the user in pulling the handle backwards is dissipated by a flat strap of nylon webbing, attached at one end to the handle, and running in an undulating path between a series of cylindrical guides to a spring-loaded drum which maintains a tension in the strap, to generate friction between the strap and the guides. Some of the guides are adjustable to vary the angle of wrap of the strap around the guides, and thereby vary the amount of friction, by means of a cam and follower arrangement. A spring loaded blocking device attached to the handle is provided to relieve the strap tension to facilitate operation of the cam and follower.

4 Claims, 6 Drawing Figures

EXERCISE MACHINES

This invention relates to exercise machines, and particularly to exercise machines which allow a user to simulate the action of rowing a boat.

Various types of such machines have already been proposed. In general, these machines comprise a frame, a foot rest and a seat both mounted on the frame, in such a way that the seat is movable generally horizontally relative to the foot rest, towards and away from the foot rest, a handle which is also movable relative to the foot rest, and resisting means which is connected to the handle and so arranged that, when the handle is pulled in the direction away from the foot rest, the movement of the handle is opposed by the resisting means, so that the user has to do work against the resisting means, thereby simulating the rowing of a boat.

In many of the previously-proposed designs of such machine, the handle is attached to the end of a flexible element such as a rope, which runs around a pulley close to the foot rest. With such a machine, the line of action of the force which the user has to exert on the handle is too low to provide and accurate simulation of the action of rowing a boat; the low level of this line of action may also make use of the exercise machine uncomfortable. A loosely-connected handle of this type may also be inconvenient, for example when the machine is to be stored.

In many of the previously-proposed designs, the resisting means against which the user has to work is a simple spring. This merely stores energy, rather than dissipating it, and therefore when the handle is allowed by the user to move back towards the foot rest, the user has to control the movement of the handle by a force of much the same magnitude as on the movement away from the foot rest. This also is different from the action of rowing a boat, since when rowing a boat, little force is needed to move the oars on the return stroke. With such machines, the muscles of the user do not have a chance to relax during the operating cycle of the machine, and, furthermore, if the user should accidentally release the handle, the handle will be pulled violently forwards towards the foot-rest by the spring.

Other designs of exercise machine for simulating the rowing of a boat employ energy-dissipating devices as the resisting means against which the user has to work, but in the previously-proposed machines, these energy-dissipating devices have operated with equal force in both the forward and return movements of the handle, so that the machines still suffer from certain of the disadvantages set out above.

In addition to the previously-proposed designs of exercise equipment, in which all the components are mounted on a frame, so that the machine is a fairly easily handled unit (apart from the loose mounting of the handle in many designs, as discussed previously) it has also been proposed to provide exercising equipment in the form of a number of disjointed components (foot rest, handle with spring, and the like) which have to be attached to the walls and/or floor of a room, for example, in order to create a functional exercise machine. Such exercising equipment is generally inconvenient, both to store and to assemble for use, and necessitates fixtures such as hooks being permanently fixed to the walls of the room.

It is an object of the invention to overcome some or all of the disadvantages exhibited by the previously-proposed exercise machines. Thus, in an exercise machine according to the present invention, the handle is constrained to move along a path which, along at least a substantial part of its length, lies at a level substantially higher than the level of the foot rest and the seat, for example by being mounted on a pivoted bar, and the resisting means is so arranged that, when the handle is moved with at least a component of movement in the direction of movement of the seat towards the foot rest, the resisting means exerts on the handle only a comparatively small force (in comparison with the force exerted on the handle by the resisting means when the handle is moved in the opposite direction) or a zero force.

Thus, during the return movement, the user's muscles are not under any substantial load, and the action of using the machine provides a fairly close simulation of a rowing action.

In a particularly preferred form of the machine, the resisting means comprises: a flexible elongate friction element connected to the handle to exert thereon a force tending to move the handle with at least a component of movement in the direction of movement of the seat towards the foot rest; tensioning means arranged to act on the flexible friction element to maintain a tension in the part of the friction element adjacent the tensioning means; and guiding means which guide the flexible friction element; the arrangement being such that movements of the handle result in reciprocating movements of at least a portion of the flexible friction element in the general direction of its own length, and that any movements of the handle which result in movement of the flexible friction element against the said tension maintained by said tensioning means also result in frictional sliding of the friction element around at least one guiding element which forms at least part of the guiding means.

With such an arrangement, the sliding of the flexible friction element around the guide element results in frictional opposition to the movement of the handle; when the handle is moving away from the foot rest, the frictional opposition magnifies the tension applied by the tensioning means, so that the user has to work against a substantial force, while when the handle is moving in the opposite direction, the frictional opposition reduces the tension applied to the tensioning means to a low value.

Advantageously, to adjust the force exerted on the handle by the flexible friction element, the machine includes means which is adjustable to vary the angle of wrap of the friction element about at least the said one guiding element. By adjusting the angle of wrap in this way, the force with which the resisting means opposes the movement of the handle away from the foot rest can be varied, without having any substantial effect on the low value of force which is exerted by the resisting means on the return stroke.

The invention may be carried into practice in various ways, but one specific embodiment, and a modification thereof, will now be described by way of example, with reference to the accompanying drawings, of which:

Figure 1:
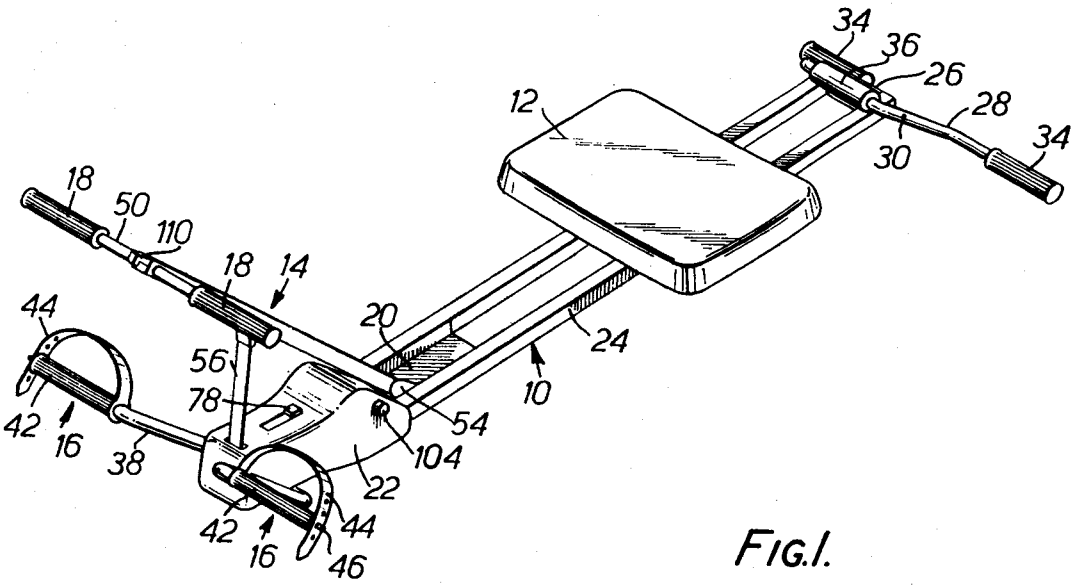
FIG. 1 is a perspective view of an exercise machine embodying the invention.

The exercise machine shown in the drawings consists essentially of a frame 10, a seat 12, and a pivoted handle 14 which can be moved against a resisting force. When the machine is in use, the user sits on the seat 12, with his feet on foot-rests 16 which form part of the frame 10, and grasps two hand-grips 18 which form part of the handle 14. The seat 12 is slidable along the frame 10, so that by straightening his legs and bending his arms and thereby pulling the handle 14, the user can simulate the action of rowing a boat, with each stroke of the handle being accompanied by a movement of the seat 12 along the frame 10. After each stroke, the user returns to his previous position; the mechanism which provides the resistance to movement of the handle 14 assists the return movement of the handle, while the return movement of the seat 12 is assisted by the fact that the frame is slightly inclined, so that the seat runs downhill during the return stroke. The construction of the exercise machine will now be described in greater detail.

The frame 10 includes, at its front end, a generally channel-shaped pressing 20, on which the various parts of the mechanism which provides the resistance to movement of the handle 14 are mounted; this mechanism is concealed beneath a moulded plastics cover 22. The frame 10 also includes a pair of square steel tubes 24, between which the rear part of the pressing 20 is received, with each of the tubes 24 being secured to the outside surface of the adjacent vertical flange of the pressing 20. The rear ends of the tubes 24 are connected by a spacer 26, and are supported above the ground by a cranked tubular support 28. The support 28 is only partly visible in the drawings, but is symmetrical about the median plane of the machine. As can be seen from FIG. 1, the support has two right angle bends between its central portion and each end. A pivot shaft 30 extends through the support between these two bends, and then through the two tubes 24, and through the other side of the support 28, so that the support can be pivoted from the position shown in FIG. 1 to that shown in FIG. 4. Each end of the support is fitted with a tubular rubber cover 34 which rests on the ground, while a further tubular rubber cover 36 is fitted to the central portion of the support 28. The rubber cover 36 abuts against the upper surface of the tubes 24 to limit the pivoting movement of the support 28 in the direction from the FIG. 4 storage position to the FIG. 1 operating position; it also acts as a resilient stop limiting the rearward movement of the seat 12 along the frame 10.

The foot-rests 16 are provided by a cranked tube 38 which is almost identical in shape to the tubular support 28. The foot-rest tube 38 is pivoted to the frame 10 by a pivot shaft 40, which passes through the foremost part of the vertical flanges of the pressing 20, and through the tube 38 in positions exactly corresponding to the points at which the pivot shaft 30 extends through the support 28. A ribbed rubber sleeve 42 is fitted over each end of the tube 38 to form the actual foot-supporting surface. A toe-strap 44 is formed integrally with each sleeve 42, being attached to the sleeve at its inboard end. A small spigot 46 is mounted in each end of the tube 38, projecting outboard beyond the sleeve 42, and the free end of each toe-strap has a row of holes, of which any one can be fitted over the spigot 46, thereby allowing the toe-straps to be adjusted for users with feet of different sizes.

Like the support 28, the tube 38 is fitted in its central portion with a tubular rubber cover 48; this abuts against the underside of the horizontal web of the pressing 20 to limit the pivoting movement of the tube 38 towards the operating position of FIG. 1, and also transfers the weight of the front end of the machine to the ground.

The seat 12 consists simply of a board provided on its upper surface with padding, and having attached to its underside a pair of brackets between which extend two transverse shafts each carrying a pair of rotatable flanged rollers which run on the upper surfaces of the frame tubes 24. In addition, the brackets are fitted with a pair of retaining lugs which co-operate with the undersides of the tubes 24 to keep the seat captive on the frame 10.

The pivoted handle 14 consists of a square steel tube having at its upper end a transverse bore which receives a round tubular handle bar 50, and having at its lower end a transverse bore by which it is pivoted on a pivot shaft 52 which is carried in bores in the vertical flanges of the pressing 20. The pivot shaft 52 is trapped in place by the tubes 24, while two spacer bushes 54 centralise the handle 14 between the flanges of the pressing 20. The handle bar 50 is rotatable in the bore in which it is received; this avoids the need for the user to allow his hands to slide around the handle bar in the course of a stroke. However, in order to encourage the user to perform some wrist action while using the machine, the angle of rotation of the handle bar 50 relative to the rest of the handle is limited. Also, in order to ensure that, when the machine is not in use, the handle bar 50 will adopt a suitable position to allow the user to take advantage of its limited rotatability, even on the first stroke, a clock-type spring within the square tube of the handle 14 biases the handle bar 50 to rotate towards the rear of the machine.

The mechanism which provides the resistance to rearwards movement of the handle 14 is largely housed within the cover 22, and includes a tape 56 of nylon webbing, which emerges from an opening formed in the top of the cover 22, near its front end, and is then attached to the handle 14. Holes 58 are provided in the handle 14, at different distances from its pivot axis, to allow the torque exerted by the tape 56 on the handle to be varied.

Figure 2:
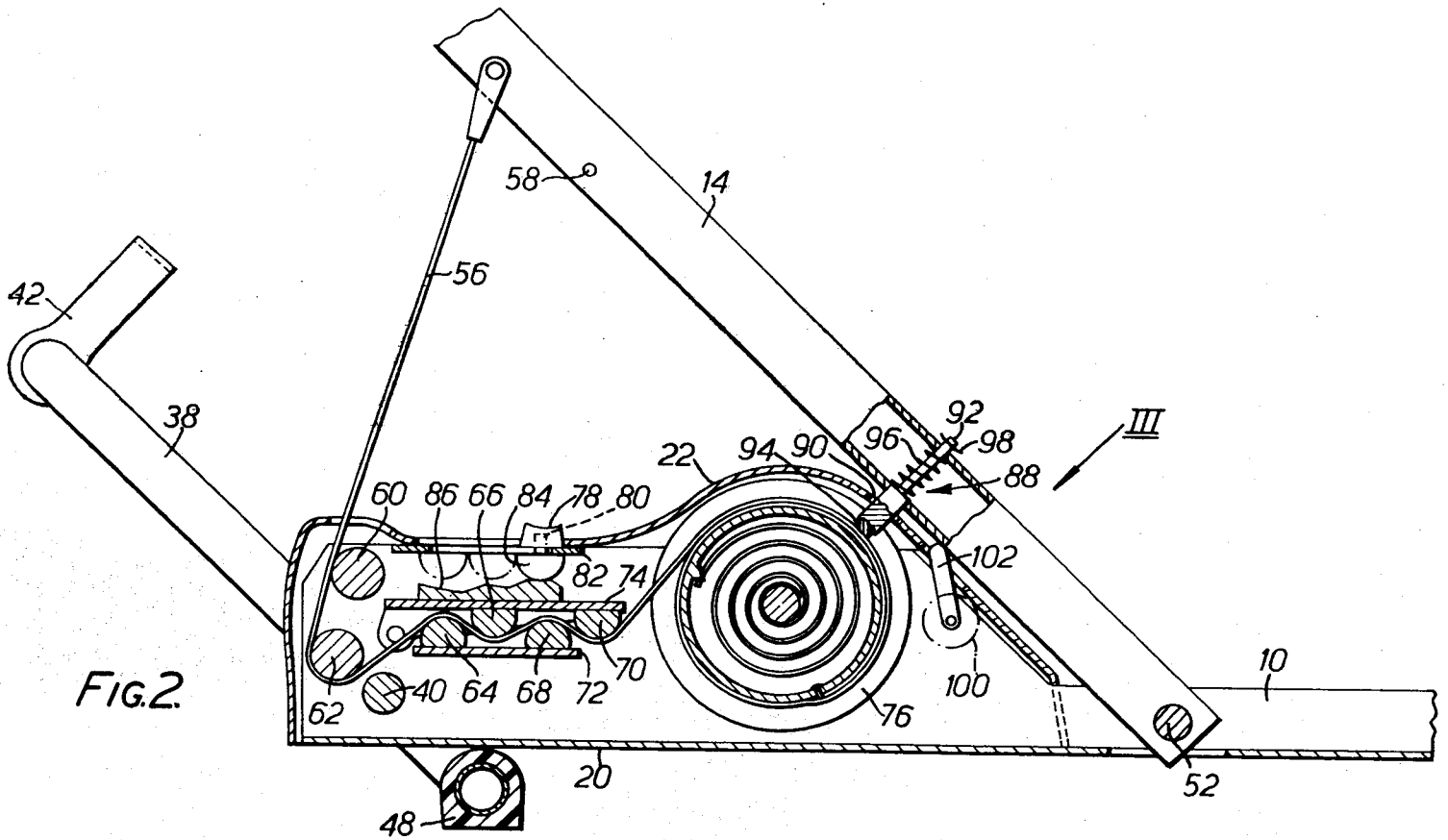
FIG. 2 is a sectional view of the front part of the machine of FIG. 1, taken on a vertical longitudinal plane.
Figure 3:
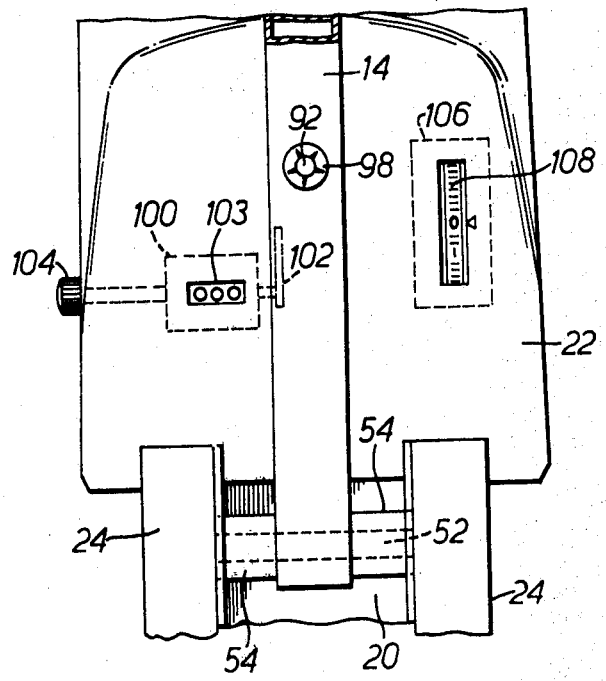
FIG. 3 is a view in the direction of the arrow III in FIG. 2.

The mechanism within the cover 22 is illustrated in FIG. 2, and is so arranged that, as the handle 14 is moved rearwards, pulling the tape 56 out of the cover 22, the tension in the tape opposing movement of the handle is considerable, while when the handle is moved forwards again, the part of the tape attached to the handle 14 is under only a slight tension. To achieve this, the tape 56, after entering the cover 22, makes a part turn about each of a series of six cylindrical or part-cylindrical guides 60, 62, 64, 66, 68 and 70. The guides 60, 62, 64 and 68 are all rigidly fixed to the frame 10; the guides 60 and 62 extend between the vertical flanges of the pressing 20, to which they are screwed at each end, while the guides 64 and 68 are mounted on a horizontal plate 72 which is fixed between the said vertical flanges. The guides 66 and 70 are also fixed to a generally horizontal plate 74, but this plate is pivoted at its front end to the flanges of the pressing 20, so that it can be adjusted up or down about a horizontal axis. In this way, the total angle of wrap of the tape 56 about the various guides can be adjusted, thereby adjusting the amount of friction which opposes movement of the tape. After leaving the guide 70, the tape 56 is wound up on a rotatable drum 76, which contains a clock-type spring arranged to maintain a tension in the tape, and is mounted on a pivot shaft extending between the flanges of the pressing 20.

In operation, the tension maintained in the tape by the spring-loaded drum 76 is magnified by the frictional sliding of the tape around the various guides as the handle 14 is moved rearwards, thereby creating a considerable tension in the part of the tape attached to the handle, but as the handle 14 is moved forwards again, the friction between the tape and guides opposes the spring biassing of the drum 76, so that the tape exerts only a slight force on the handle.

As mentioned above, the position of the plate 74 carrying the guides 66 and 70 can be adjusted. To control the position of the plate 74, an adjustment knob 78 is provided, which is slidable in a fore-and-aft direction, and projects through a slot in the top of the cover 22 to be movable by the user of the machine. The knob 78 is mounted on a spigot 80 which projects vertically upwards, through a slot in a fixed horizontal plate 82, from a hemispherical button 84 formed integrally with the spigot. A plastics washer is provided between the upper surface of the button 84 and the plate 82, to facilitate sliding of the button along the slot. The plate 82 is fixed to the flanges of the pressing 20, and overlies the pivoted plate 74. The button 84 limits the upward movement of the plate 74 by abutting against a ramp member 86 mounted on the top of the plate 74; the ramp member has an upper surface in the form of a shallow switchback, providing three stable positions for the button 84 (one shown in full line and two in chain-dotted line in FIG. 2). With the button 84 in its most forward position, the plate 74 can rise to a fairly high position; if the button is moved to its middle position by means of the knob 78, the plate 74 will be moved downwards, thereby increasing the angle of wrap of the tape 56 about the guides 64, 66, 68 and 70, and increasing the amount of friction between the tape and the guides. By moving the knob 78 to its rearmost position, the plate 74 will be depressed further, providing another increase in the amount of friction.

Because the tension which is normally present in the tape 56 tends to force the plate 74 with the guides 66 and 70 upwards, the force required to move the knob 78 may be excessive, especially in the friction-increasing direction. To provide for easier adjustment of the knob 78, a spring-loaded buffer 88 is mounted on the handle 14, and a corresponding hole 90 is provided in the cover 22 to allow the buffer 88 to press against the tape 56 at a point where it is wound on the drum 76. The construction of the buffer can be seen in FIG. 2. It comprises a shank 92 slidably received in the handle 14, and carrying a rubber pad 94; a helical compression spring 96 provides the spring bias for the buffer, and a spring clip 98 fitted to the rear end of the shank 92 retains the buffer in place. The tension in the tape 56 as the handle 14 moves forward is insufficient to cause any compression of the buffer spring 96, but when it is desired to adjust the knob 78 to vary the resistance to movement of the handle 14, the handle can be manually pushed forward from its normal idle forward position. This compresses the buffer spring 96, and the pressure of the buffer against the tape 56 prevents the drum 76 from rotating and reeling in the tape through the various guides. Consequently, the tape becomes slack, and the knob 78 can easily be adjusted.

The pressure of the buffer 88 also ensures that, if the handle 14 should be allowed to fly forward under the influence of the tension in the tape 56, its momentum will be absorbed by the buffer 88 and the drum 76, rather than by the comparatively fragile cover 22.

The machine also includes a mechanical counter 100 arranged to count the number of strokes of the handle made by the user of the machine. The counter is mounted on the left-hand flange of the pressing 20, and has an operating lever 102 which projects through a slot in the rear of the cover 22. Another slot 103 allows the readout of the counter to be seen. The lever 102 is spring-loaded to the rear, but is moved forward by the handle 14 every time the latter reaches the front of its stroke, incrementing the count by one. The counter 100 can be reset to zero by means of a reset knob 104 which projects from the side of the cover 22.

The machine also includes a timer 106, which, in conjunction with the counter 100, allows the user to access the rate at which he is exercising. The timer 106 is mounted on the right-hand flange of the pressing 20, and incorporates a conventional clockwork mechanism. The timer also incorporates a thumb wheel 108 which is calibrated in minutes, and is used to wind up the timer for the required number of minutes. The thumb wheel 108 projects through a further slot in the rear of the cover 22 to be accessible by the user of the machine. At the end of the set time period, a bell is sounded by the timer.

Figure 4:
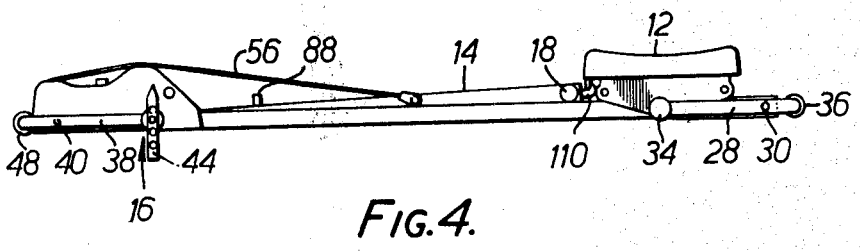
FIG. 4 is a side elevation of the machine of FIG. 1 in a storage position.

FIG. 4 illustrates how the machine can be made more compact for storage. The support 28 for the rear end of the frame 10 is pivoted to bring its free ends, with the covers 34, forward and into the general plane of the frame 10. Similarly, the foot-rest tube 38 is pivoted to bring the foot-rest sleeves 42 rearwards into the general plane of the frame. Finally, the upper end of the handle 14 is provided with a hook 110 (best seen in FIG. 1), which allows the handle to be hooked under a bracket provided under the seat 12, near the front edge of the seat. The seat has first to be moved to its rearmost position; the handle 14 is then pulled right back, to move the hook 110 below the level of the seat, the seat is moved forwards over the hook 110, and the handle 14 is then released.

Figure 5:
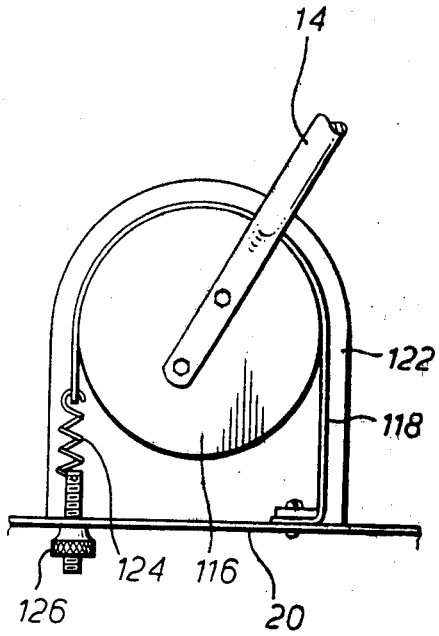
FIG. 5 is a side view of part of a modified form of the exercise machine of FIGS. 1 to 4.
Figure 6:
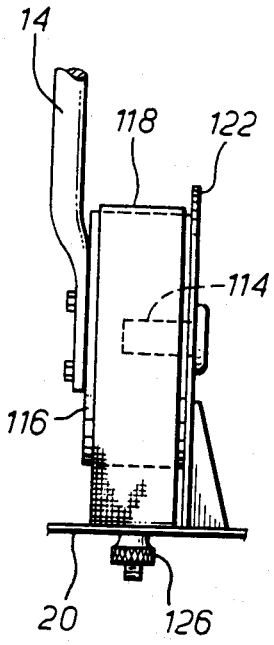
FIG. 6 is a front view of the parts shown in FIG. 5.

FIGS. 5 and 6 illustrate an alternative arrangement resisting movement of the handle 14, with a greater resistance in one direction than in the other. This arrangement includes a smooth surfaced friction drum 116, which is mounted for rotation on a stub shaft 114. The shaft 114 is fixed on a mounting plate 122 which is in turn fixed on the pressing 20. The lower end of the handle 14 is attached to the drum 116, and a friction strap 118 of synthetic textile webbing is wrapped around the drum 116. One end of the strap 118 is anchored directly to the pressing 20, while the other end of the strap is connected to a tension spring 124, which is in turn connected to the pressing 20 by a screw adjuster 126.

When the handle 14 is moved rearwards, the drum 116 rotates anti-clockwise (as seen in FIG. 5). The presence of the spring 124 means that even with a slight anticlockwise shift of the strap 118, the tension in the left-hand part of the strap will remain substantially constant at the value set by the adjuster 126. In contrast, the tension in the right-hand part of the strap 118 will rise considerably with a slight anti-clockwise movement of the strap and when the ratio between the tensions in the two parts of the strap reaches a value set by the coefficient of friction between the drum and the strap, and by the angle of contact between the drum and the strap, slipping will occur.

In a similar manner, when the handle 14 is moved forwards again the elasticity of the spring 124 tends to keep the tension in the left-hand part of the strap substantially constant, despite any slight clockwise movement of the strap, but such a movement will cause a considerable reduction in the tension in the right-hand part of the strap. Again, slipping will occur when the ratio of these tensions reaches a certain value.

It can be shown mathematically that the force required to move the handle rearwards is greater than that required to move the handle forwards by a factor of $e^{\mu\theta}$. It will also be realised that with this arrangement, the handle is not automatically biassed to its forward position; if such a bias is considered desirable, a suitable biassing spring can be provided.

What we claim as our invention and desire to secure by Letters Patent is:

1. In an exercise machine comprising a frame, a foot rest and a seat, both mounted on the said frame in such a way that the said seat is movable generally horizontally longitudinally towards and away from said foot rest, a stem bar, a handle mounted in the vicinity of the upper end of said stem bar, means for connecting said stem bar at its lower end to said frame for moving said handle along an arcuate path in an upright longitudinally extending plane, wherein at a position intermediate the ends of the arcuate path said handle lies at a level substantially higher than the level of said foot rest and said seat, and resisting means for opposing movement of said handle away from said foot rest, the improvement comprising:

flexible elongate tension-bearing means for interconnecting said resisting means and said stem bar and for transmitting the resisting force from said resisting means to said stem bar, wherein said resisting means is longitudinally spaced from said lower end and mounted to said frame substantially at the level of said foot rest, and wherein said tension bearing element is connected to said stem bar between said upper and lower ends at a distance spaced from said lower end so that said tension-bearing means acts in a generally horizontal direction parallel to said stem bar as said handle approaches the end of said arcuate path upon movement away from said foot rest so as to reduce the force exerted by said resistance means in opposition to movement of said handle;

wherein said resisting means comprises a flexible elongate friction element connected to said elongate flexible tension-bearing means for movement with said handle; biasing means acting on said flexible friction element for urging said handle toward said foot rest, and means for guiding said flexible friction element for producing substantial frictional resistance to movement of said flexible friction element and thereby said handle when said handle is pulled away from said foot rest in opposition to said biasing means, thereby creating increased tension in said flexible tension element, and for producing relatively little frictional resistance to movement of said friction element when said handle moves toward said foot rest and said tension is reduced, wherein the guiding means comprises a series of fixed guide elements arranged to constrain said friction element to follow an undulating path.

2. An exercise machine as claimed in claim 1, in which the said seat is guided for movement along a part of the said frame of the machine, which part runs downhill towards the said foot rest.

3. An exercise machine as claimed in claim 1, in which the said flexible friction element is a flat strap of synthetic textile webbing.

4. An exercise machine as claimed in claim 1, which also includes means arranged to count movements of the handle.

* * * * *